United States Patent [19]

Katz

[11] 4,194,111

[45] Mar. 18, 1980

[54] TIDAL DEPTH CALCULATOR

[76] Inventor: Joseph Katz, 529 Main St., Box 69, Stoneham, Mass. 02180

[21] Appl. No.: 954,594

[22] Filed: Oct. 25, 1978

[51] Int. Cl.[2] ..... G06C 3/00; G06C 27/00

[52] U.S. Cl. ..... 235/83; 235/88 R; 235/89 R

[58] Field of Search ..... 235/83, 84, 70 A, 89 R, 235/88 R, 88 N, 78 R; 58/3; 84/474

[56] References Cited

U.S. PATENT DOCUMENTS

| | | | |
|---|---|---|---|
| 569,340 | 10/1896 | Low | 58/3 |
| 3,058,653 | 10/1962 | Granges | 235/88 R |
| 3,621,750 | 11/1971 | Leonard | 235/89 R |
| 3,703,804 | 11/1972 | Appelberg | 58/3 |
| 3,745,313 | 7/1973 | Spilhaus | 58/3 |
| 3,842,707 | 10/1974 | Leonard | 84/474 |

FOREIGN PATENT DOCUMENTS

| | | | |
|---|---|---|---|
| 2229095 | 12/1974 | France | 235/70 A |

*Primary Examiner*—Stephen J. Tomsky

[57] ABSTRACT

There is disclosed a marine navigational calculator device of the slide rule type whereby tidal depths over bottom structures may be determined as a function of the time of the tide or time of calendar day and whereby the entire time span available to a mariner to successfully negotiate such charted bottom structures for a given tidal flow is visually presented.

15 Claims, 2 Drawing Figures

| | | | | | | | | | | | | | | |
|---|---|---|---|---|---|---|---|---|---|---|---|---|---|---|
| 1 FT. | 0 | 0.1 | 0.3 | 0.5 | 0.8 | 0.9 | 1.0 | 0.9 | 0.8 | 0.5 | 0.3 | 0.1 | 0 | |
| 2 | 0 | 0.2 | 0.5 | 1.0 | 1.5 | 1.8 | 2.0 | 1.8 | 1.5 | 1.0 | 0.5 | 0.2 | 0 | |
| 3 | 0 | 0.3 | 0.8 | 1.5 | 2.3 | 2.8 | 3.0 | 2.8 | 2.3 | 1.5 | 0.8 | 0.3 | 0 | |
| 4 T | 0 | 0.3 | 1.0 | 2.0 | 3.0 | 3.7 | 4.0 | 3.7 | 3.0 | 2.0 | 1.0 | 0.3 | 0 | |
| 5 I | 0 | 0.4 | 1.3 | 2.5 | 3.8 | 4.6 | 5.0 | 4.6 | 3.8 | 2.5 | 1.3 | 0.4 | 0 | |
| 6 D | 0 | 0.5 | 1.5 | 3.0 | 4.5 | 5.5 | 6.0 | 5.5 | 4.5 | 3.0 | 1.5 | 0.5 | 0 | |
| 7 A | 0 | 0.6 | 1.8 | 3.5 | 5.3 | 6.4 | 7.0 | 6.4 | 5.3 | 3.5 | 1.8 | 0.6 | 0 | |
| 8 L | 0 | 0.7 | 2.0 | 4.0 | 6.0 | 7.3 | 8.0 | 7.3 | 6.0 | 4.0 | 2.0 | 0.7 | 0 | |
| 9 | 0 | 0.8 | 2.3 | 4.5 | 6.8 | 8.3 | 9.0 | 8.3 | 6.8 | 4.5 | 2.3 | 0.8 | 0 | |
| 10 R | 0 | 0.8 | 2.5 | 5.0 | 7.5 | 9.2 | 10. | 9.2 | 7.5 | 5.0 | 2.5 | 0.8 | 0 | |
| 11 A | 0 | 0.9 | 2.8 | 5.5 | 8.3 | 10.1 | 11. | 10.1 | 8.3 | 5.5 | 2.8 | 0.9 | 0 | |
| 12 N | 0 | 1.0 | 3.0 | 6.0 | 9.0 | 11.0 | 12. | 11.0 | 9.0 | 6.0 | 3.0 | 1.0 | 0 | |
| 13 G | 0 | 1.1 | 3.3 | 6.5 | 9.8 | 11.9 | 13. | 11.9 | 9.8 | 6.5 | 3.3 | 1.1 | 0 | |
| 14 E | 0 | 1.2 | 3.5 | 7.0 | 10.5 | 12.8 | 14. | 12.8 | 10.5 | 7.0 | 3.5 | 1.2 | 0 | |
| 15 | 0 | 1.3 | 3.8 | 7.5 | 11.3 | 13.8 | 15. | 13.8 | 11.3 | 7.5 | 3.8 | 1.3 | 0 | |
| 16 | 0 | 1.3 | 4.0 | 8.0 | 12.0 | 14.7 | 16. | 14.7 | 12.0 | 8.0 | 4.0 | 1.3 | 0 | |

| 0600 | LOW TIDE | | 22(b) | | | | | | | | | | LOW TIDE | 1800 |
|---|---|---|---|---|---|---|---|---|---|---|---|---|---|---|
| 1 FT. | 0 | 0.1 | 0.3 | 0.5 | 0.8 | 0.9 | 1.0 | 0.9 | 0.8 | 0.5 | 0.3 | 0.1 | 0 | |
| 2 | 0 | 0.2 | 0.5 | 1.0 | 1.5 | 1.8 | 2.0 | 1.8 | 1.5 | 1.0 | 0.5 | 0.2 | 0 | |
| 3 | 0 | 0.3 | 0.8 | 1.5 | 2.3 | 2.8 | 3.0 | 2.8 | 2.3 | 1.5 | 0.8 | 0.3 | 0 | |
| 4 T | 0 | 0.3 | 1.0 | 2.0 | 3.0 | 3.7 | 4.0 | 3.7 | 3.0 | 2.0 | 1.0 | 0.3 | 0 | |
| 5 I | 0 | 0.4 | 1.3 | 2.5 | 3.8 | 4.6 | 5.0 | 4.6 | 3.8 | 2.5 | 1.3 | 0.4 | 0 | |
| 6 D | 0 | 0.5 | 1.5 | 3.0 | 4.5 | 5.5 | 6.0 | 5.5 | 4.5 | 3.0 | 1.5 | 0.5 | 0 | |
| 7 A | 0 | 0.6 | 1.8 | 3.5 | 5.3 | 6.4 | 7.0 | 6.4 | 5.3 | 3.5 | 1.8 | 0.6 | 0 | |
| 8 L | 0 | 0.7 | 2.0 | 4.0 | 6.0 | 7.3 | 8.0 | 7.3 | 6.0 | 4.0 | 2.0 | 0.7 | 0 | |
| 9 | 0 | 0.8 | 2.3 | 4.5 | 6.8 | 8.3 | 9.0 | 8.3 | 6.8 | 4.5 | 2.3 | 0.8 | 0 | |
| 10 R | 0 | 0.8 | 2.5 | 5.0 | 7.5 | 9.2 | 10. | 9.2 | 7.5 | 5.0 | 2.5 | 0.8 | 0 | |
| 11 A | 0 | 0.9 | 2.8 | 5.5 | 8.3 | 10.1 | 11. | 10.1 | 8.3 | 5.5 | 2.8 | 0.9 | 0 | |
| 12 N | 0 | 1.0 | 3.0 | 6.0 | 9.0 | 11.0 | 12. | 11.0 | 9.0 | 6.0 | 3.0 | 1.0 | 0 | |
| 13 G | 0 | 1.1 | 3.3 | 6.5 | 9.8 | 11.9 | 13. | 11.9 | 9.8 | 6.5 | 3.3 | 1.1 | 0 | |
| 14 E | 0 | 1.2 | 3.5 | 7.0 | 10.5 | 12.8 | 14. | 12.8 | 10.5 | 7.0 | 3.5 | 1.2 | 0 | |
| 15 | 0 | 1.3 | 3.8 | 7.5 | 11.3 | 13.8 | 15. | 13.8 | 11.3 | 7.5 | 3.8 | 1.3 | 0 | |
| 16 | 0 | 1.3 | 4.0 | 8.0 | 12.0 | 14.7 | 16. | 14.7 | 12.0 | 8.0 | 4.0 | 1.3 | 0 | |

TIDAL DEPTH CALCULATOR

BACKGROUND OF THE INVENTION

The present invention relates generally to navigational calculators and is more particularly concerned with a slide rule type tidal water depth calculator.

In marine navigation it is important that the vessel operator have contemporaneous knowledge of the depth of water over bottom structures in order to avoid accidental grounding thereon. This is particularly so where the vessel operates in relatively shallow waters such as, for instance is often the case in harbor operations, commercial or sport fishing, sailboat racing and the like. Commercial fisherman, for example, often operate in relatively shallow waters or are required to navigate their vessels across shallow bottom structures such as sand bars, shoals and reefs in order to reach their intended fishing grounds. It is also often of importance in commercial fishing that the crew be provided with as much actual working or "loiter" time over the fishing grounds as possible. Where a shallow bottom structure is interposed between the fishing grounds and the home port of the vessel, this "loiter" time is often severely restricted due to the fact that the draft of the vessel will not admit of traversing the shallow structure other than at times of substantial water depth. Should the vessel work too long over the fishing grounds during ebb tide, it is possible that the return trip to port cannot be safely made by the most expeditious route, in other words, directly over the intervening shallow structure. Rather, it can be found necessary to circumnavigate said structure thereby often substantially increasing the length of the trip and increasing use of fuel, refrigeration and other consumables of substantial value. Alternatively, the vessel may be required to remain over the fishing grounds until the tide once again floods sufficiently to provide safe water depth over the intervening shallow bottom structure. This expedient, however, also increases the length of the trip and the expenditure of consumables. Situations similar to the foregoing obviously also often attend the lot of the sport fisherman.

To the sailing enthusiast the depth of water under the keel is also of critical importance, particularly since sailing craft usually comprise keels of substantial depth relative to the displacement of the vessel. In sailboat racing and cruising, for instance, the chosen course for any given leg of a race or trip can be as much dictated by consideration of clearance of the keel over bottom structures as upon direction and velocity of wind and current.

In view of the foregoing, therefore, it is clearly desirable that there be provided an instrument by which the depth of water over charted structures can be readily calculated as a function of the time of the tide and/or by which the times of critical water depths relative to safe passage of a vessel over chartered structures can be quickly obtained. In accordance with the present invention, such a device has now been provided.

OBJECTS OF THE INVENTION

It is a principal object of the present invention to provide a novel tidal water depth calculator.

It is another object of the invention to provide a marine navigational instrument by which a vessel operator can determine the depths of water in charted waters for any given time of day or tide and/or to determine the time span within which sufficient depth of water over charted bottom structures will exist for safe passage of his vessel.

Other objects and advantages of the present invention will in part be obvious and will in part appear hereinafter.

SUMMARY OF THE INVENTION

In accordance with the invention there is provided a slide rule type calculator device comprising a sliding element and a stationary element, said elements being adapted for relative motion therebetween. One of said elements bears thereon indicia representative of sequential time intervals spanning at least one complete tide cycle or twelve-hour period. The other of said elements bears thereon a tidal range table comprising a tidal range list and, keyed thereto, a table of tide depths in which the depth entries are arranged as a function of the sequential time intervals. Means are provided by which to index the sliding element to the stationary element and to thereby key the starting time of a tidal cycle to said tidal range table. Reference means are also provided by which to key the time intervals of the one element to the sequentially arranged table of tide depths of the other element.

THE DRAWING

FIG. 1 hereof is a schematic, diagrammatic plan view of one embodiment of the invention comprising a circular slide rule.

FIG. 2 hereof is a schematic, diagrammatic plan view of the sliding element 10 of the circular slide rule of FIG. 1.

DESCRIPTION OF PREFERRED EMBODIMENTS

Figure 1:
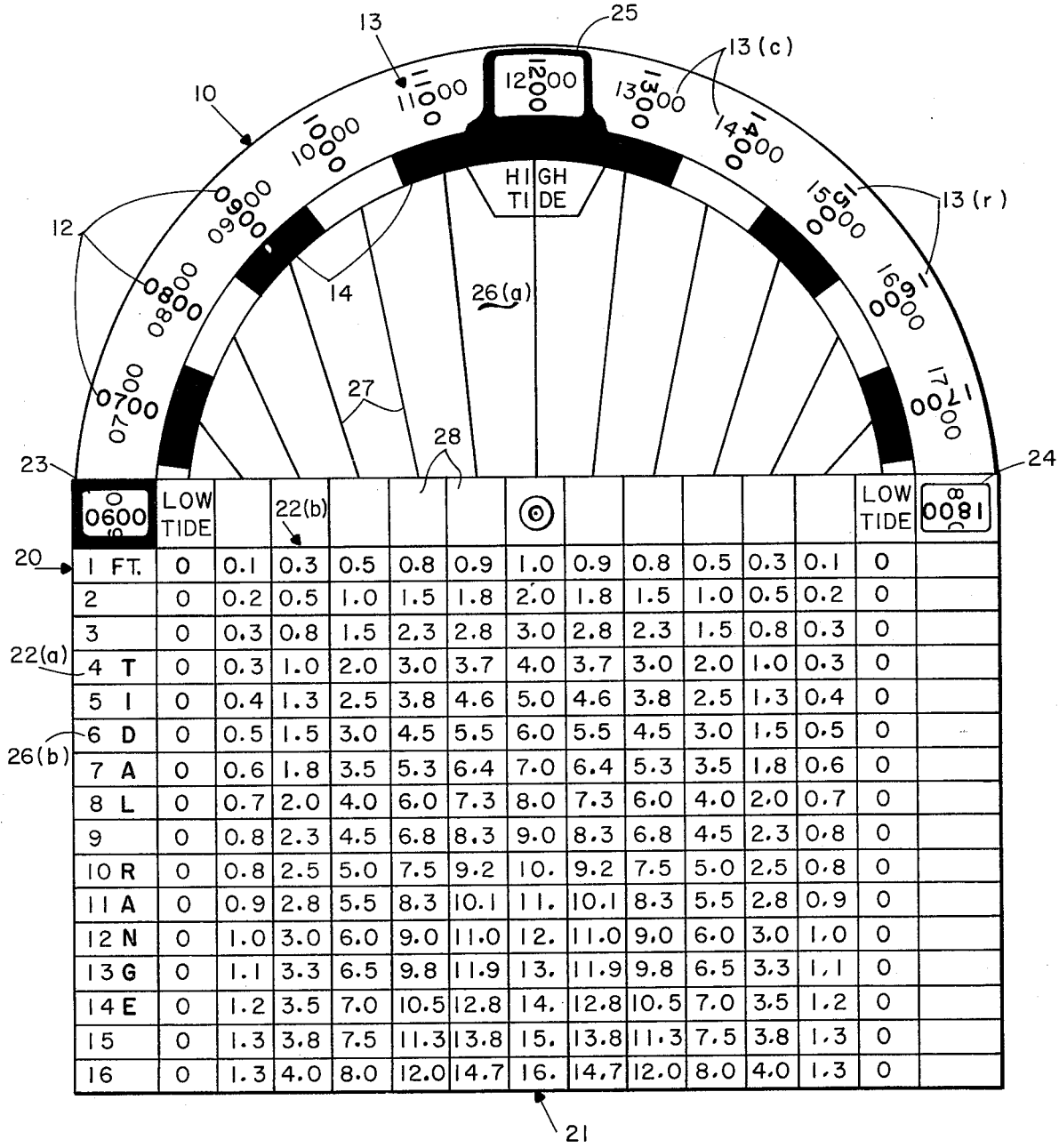
Figure 2:
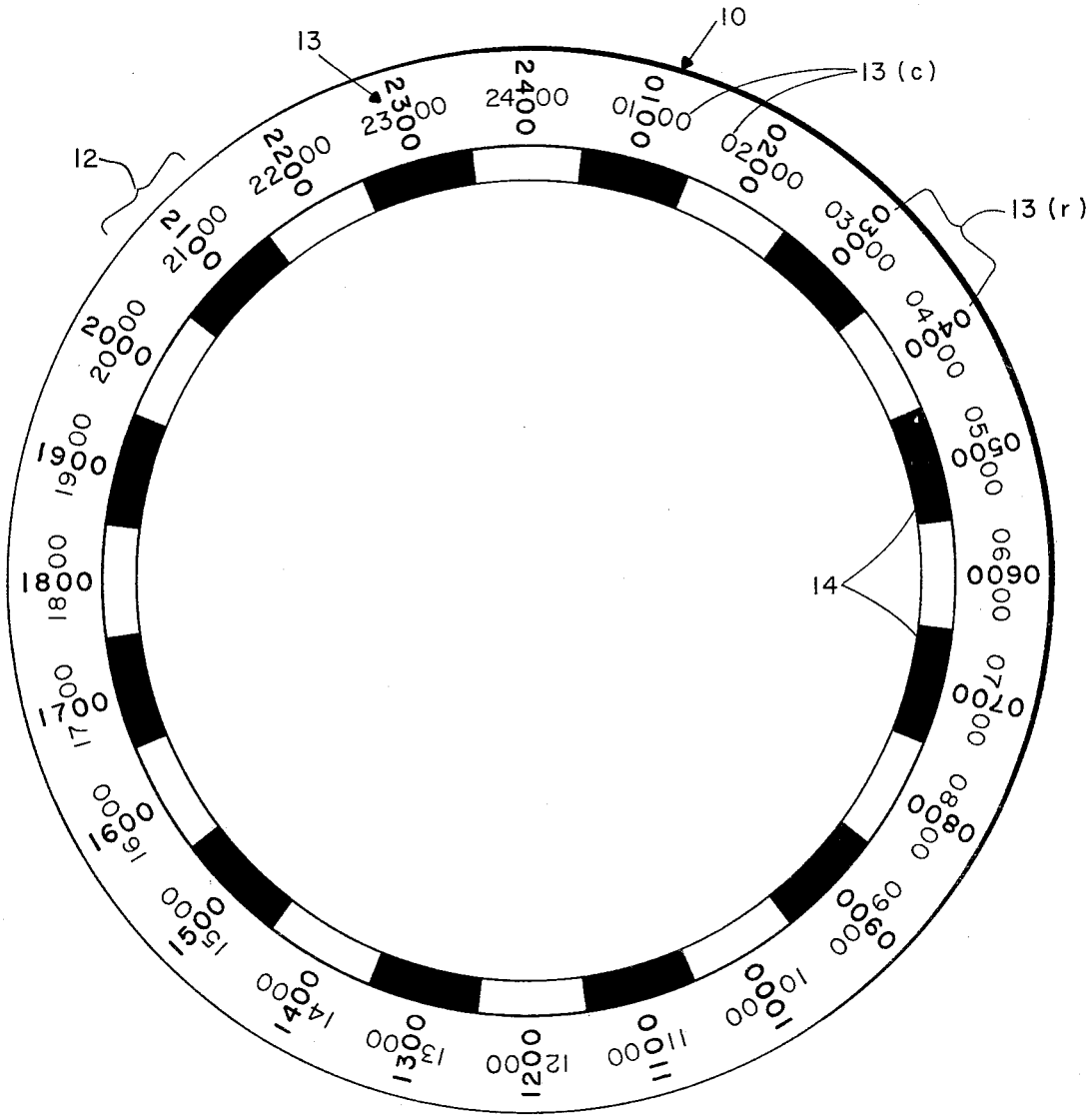

Referring now to FIGS. 1 and 2, wherein like reference numerals refer to like structures, the marine navigational calculator device of the invention broadly comprises a sliding element 10 and a stationary element 20. In the embodiment shown the device of the invention is in the form of a circular or disk type slide rule which, as compared to a slide rule of the bar type, is conservative of space and therefore constitutes a preferred form. Accordingly, the sliding element 10 of the drawing is in the form of a disk which is pinned, riveted or otherwise rotatably fixed to the stationary element 20. As shown more clearly in FIG. 2 the circumference of the disk shaped sliding element 10 bears indicia thereon dividing it into equal sequential time intervals 12 which embrace a time span of at least one complete tide cycle (twelve hours) and, preferably, a time span of twenty-four hours. The time intervals 12 are marked with serially advancing reference time notations 13, said notations 13 being preferably, although not necessarily, derived from the twenty-four hour clock (0000 to 2400). Where the element bearing the time interval indicia is the sliding element and is in the form of a rotatable disk, it is further preferred that each of the time interval notations 13 be presented both circmferentially, 13(*c*), and radially 13(*r*), thereby to ease the task of reading thereof irrespective of the angular position of the disk relative to the stationary element 20. It is also preferred that adjacent time intervals 12 be marked in a manner such as to visually demarcate said adjacent intervals 12 one from the other. This can be accomplished, for instance, by the provision of arcuate bars 14 located at the interior circumference of alternate time intervals 12.

Said bars 14 terminate at the one-half hour marks lying to either side of the particular hour embraced thereby. Such clear-cut separations of the time intervals 12 as are provided by the bars 14 serve to mitigate against accidential misreading of the time interval indicia.

Stationary element 20 comprises a tidal range table 21 wherein depth changes due to tidal flow are tabularized as a function of advancing time and are keyed to a tidal range list 22(*a*). Accordingly, the lefthand column of the table 21 shown in FIG. 1 comprises a tidal range list 22(*a*) wherein a plurality of tidal ranges are sequentially and vertically listed. A table of tidal depths 22(*b*) is keyed to the tidal range list 22(*a*) and forms a major part of tidal range table 21. The entries of said table of tidal depths 22(*b*) are disposed laterally and in temporal sequence across said table 21, the starting point thereof being selected, as a matter of convenience, as low tide. As will be noted, the values of the entries comprising table of tidal depths 22(*b*) do not proceed in an arithmetic progression; in other words, tidal depths do not increase or decrease incrementally by one-sixth of the tidal range keyed thereto. Rather, it is in the nature of things that the rates of depth change occurring during the beginning and terminal hours of each tidal flow are substantially smaller than the rates of depth change, expressed in terms of percent of total tidal range, which occur towards mid-tide. Tidal depth changes proceed approximately according to the following schedule:

| Hour starting at low or high tide | first | second | third | fourth | fifth | sixth |
|---|---|---|---|---|---|---|
| % of total tidal change | 8 | 17 | 25 | 25 | 17 | 8 |

The calculator device of the invention also includes means by which to index the sliding element 10 to the stationary element 20, thereby to key the starting time of a tidal cycle to the tidal range table 21. Said starting time can be conveniently taken as the time of the previous low or high tide. In the embodiment of the invention shown in the drawing the selected starting time is the time of the previous low tide and the indexing means comprises a window 23 forming part of stationary element 20 and through which window the time of said previous low tide is caused to appear by suitable rotation of the sliding element 10 relative to the stationary element 20. Equally suitable for purposes of properly indexing the sliding element 10, is window 24 within which the time of the next low tide is caused to appear. Finally, it is also preferred that the time of the intermediate high or low tide, depending upon whether the starting time is taken as the time of low or high tide, respectively, also will be highlighted, thereby completing visual presentation of a complete tidal cycle. Where, as in the embodiment of the invention shown in the drawing, the starting time is taken as the time of the preceding low tide, the time of the succeeding high tide can be visually called out by the provision of a third indexing window, window 25, located intermediate the start and finish indexing windows 23 and 24, respectively. For a disk type calculator wherein the disk element comprises the time interval indicia, said index window 25 can be located at the apex of a semicircular portion 26(*a*) of stationary element 20 which extends above a rectangular portion 26(*b*) occupied by the tidal range table 21. Obviously, other forms of suitable indexing means will suggest themselves to those of skill. For instance, simple indexing marks such as arrows can be employed instead of the specific window structures depicted in FIG. 1.

Also included in the calculator device of the invention are means to visually reference sequential time intervals 12 to their corresponding depth entries of the table of tidal depths 22(*b*). This can be conveniently accomplished, for instance, by means of a plurality of reference lines 27 which are drawn across semicircular portion 26(*a*) between the exposed time intervals 12 of sliding element 10 and the corresponding columns 28 of the table of tidal depths 22(*a*).

Use of the calculator device of the invention as shown in the drawing and hereinbefore described will now be described with respect to the solution of two common marine navigation problems. The first such problem is one of present or future time and can be posed simply as to whether or not sufficient depth of water is or will be available to successfully negotiate a charted bottom structure at a given present or future time. Four items of information are required for effective use of said calculator in the solution of this problem. The first such item is the time of the preceding low tide in the locale of the structure. This information can be derived from several publications including national and local newspapers, almanacs and various tide tables printed and made generally available to mariners operating in the same locale. Such information would also be generally obtainable by radiotelephone inquiry of the nearest U.S. Coast Guard facility. The second item of information is the predicted tidal range for the particular tide under consideration. This information, as well as the times of tides, is available from the governmental publication *TIDE TABLES* (*YEAR*), *HIGH AND LOW WATER PREDICTIONS,* U.S. Department of Commerce, National Oceanic and Atmospheric Administration. It is also available from such private publications as *ELDRIDGE TIDE AND PILOT* (*YEAR*), Robert Eldridge White, Boston, Massachusetts, 02110. The third item of information required is the draft of the vessel involved. In the case of small boats this information will usually be well known to the operator thereof and, in the case of larger vessels, can be derived by suitable computation and/or by direct observation of the waterline depth scale which is conventionally applied to the bow of the vessel. The fourth item of information required is contained in all governmental navigation charts embracing the navigable waters of the United States and other maritime nations. Therein, information as to the depths of bottom structures is uniformly given as the depth of water over the structure at mean low tide. With this information in hand, the sliding element 10 of the calculator is first indexed such that the time of the preceding low tide appears in window 23. Alternatively, the time of the intermediate high tide may be set in window 24 as any one of these operations will result in equivalent indexing and proper exposure of the time intervals 12 of sliding element 10. The operator then selects the appropriate tidal range from tidal range list 22(*a*) and scans that line to the depth entry of table of tidal depths 22(*b*) which interacts with the proposed time of crossing of the vessel over the charted bottom structure. To this depth entry there is then added the charted mean low tide depth of the structure, thereby yielding as a sum the total depth of water to be expected over this structure at the proposed time of crossing. The draft of the vessel is then subtracted from this sum, thereby yielding as the difference the depth of water between the structure and the hull of the vessel. Where the difference is a positive (+) value, there exists clearance by approximately the numerical value of the difference. Where the difference is a negative (−) value, however, the draft of the vessel is greater than the depth of water over the structure and passage thereover at the selected time is contraindicated.

In a somewhat similar manner, the vessel operator may also gain knowledge of the total time span available to him when safe passage over a charted bottom structure may be achieved. This is of particular value where, for instance, a lengthy sand bar interposes between the vessel and its intended destination. Here, the vessel operator employs the calculator of the invention by suitably indexing the sliding element 10 thereof as explained previously. Then, the draft of the vessel is subtracted from the mean low water depth of the structure to be negotiated. In the case where the time of crossing over the structure is critical in respect of adequate clearance, this difference will be a negative (−) value. Next, selecting the appropriate tidal range from list 22(*a*), the vessel operator scans table 22(*b*) for the minimum tidal depth which, when added to that negative difference, result in a positive (+) sum. Two depth entries will be found per line of the table 22(*b*) which satisfy this minimum criterion, assuming, of course, that the bottom structure is negotiable at all for the tidal range of that tide. The vessel operator then follows the reference lines 27 from the columns 28 containing these two minimum depth entries to the particular time intervals 12 keyed thereto. The entire time span available by which to negotiate the structure will then reside between these two time intervals.

As will be appreciated, the calculator device of the invention, as used in accordance with the above description, yields results which tend to be approximate in nature. For instance, the effects of wind or barometric pressure on tidal depths are not specifically taken into account in the use of the calculator as previously described. Furthermore, the tidal cycle has been, for purposes of convenience, taken as a twelve hour cycle when, in reality, said cycle is more accurately a twelve hour and twenty-five minute cycle. This, too, results in a minor approximation. Accordingly, the information provided by the calculator device of the invention should not be taken as of absolute accuracy and, in consequence, it is recommended that the user thereof exercise reasonable care in its use by applying an added margin of safety appropriate for the prevailing conditions.

Having thus described the invention, it is apparent that many changes, modifications and alterations may be made in the device as hereinbefore specifically described in reference to particular embodiments thereof. For instance, the slide rule of the invention may take the form of a bar type slide rule rather than the disk type specifically shown and described. Moreover, the locations of the time interval indicia and tidal range table information may be reversed with respect to the sliding and stationary elements. Additionally, if desired, the side of the calculator device not shown in the drawing can, if desired, be imprinted with similar indicia to carry out similar functions or can be provided with different indicia to carry out other navigational or mathematical functions. For instance, in the first case, the obverse side can be imprinted in I.S.U. units so as to yield depth information in metric units. In the second case, as an example, the obverse side of the calculator can be imprinted with scales suitable for solving time-rate-distance problems.

Accordingly, although specific preferred embodiments of the invention have been described in detail above, the description is not intended to limit the invention to these embodiments since they are intended to be construed as illustrative rather than as restrictive or limiting in any way. Thus, the invention is not to be limited to the details disclosed in the foregoing description but may be modified within the scope of the appended claims.

What is claimed is:

1. A tidal depth calculator device of the slide rule type comprising: a sliding element and a stationary element, said elements being connected for relative motion therebetween; one of said elements having indicia thereon representative of sequential time intervals spanning at least a twelve hour period; the other of said elements having thereon a tidal range table comprising a list of tidal ranges and a table of tide depths comprising a plurality of tidal depth entries keyed to each tidal range of said list, said entries being arranged in sequential time interval order embracing a tide cycle; means to index the one element to the other element, thereby to key the time interval indicia of the one element representing the starting time of a tidal cycle to said tidal range table of the other element; and reference means to key the time intervals of the indexed one element to the tide depth entries of the other element.

2. The calculator device of claim 1 wherein said indicia of said one element spans a time period of twenty-four hours.

3. The calculator device of claim 1 in the form of a circular slide rule.

4. The calculator device of claim 1 wherein said indexing means comprises a window located on said other element whereby any one of said time interval indicia of said one element can be caused to appear in said window by said relative motion of the one element to the other.

5. The calculator device of claim 4 including additional windows appropriately spaced from said indexing window to display therethrough the finishing time of the tidal cycle and the intermediate time of the tidal cycle.

6. The calculator device of claim 1 wherein said starting time of the tidal cycle is the time of previous low tide.

7. The calculator device of claim 1 wherein said starting time of the tidal cycle is the time of previous high tide.

8. The calculator device of claim 1 comprising means to visually demarcate adjacent time intervals of said one element.

9. The calculator device of claim 1 wherein said sliding element is said one element and wherein said stationary element is said other element.

10. The calculator device of claim 1 wherein said sliding element is said one element and is in the form of a disk.

11. The calculator device of claim 10 wherein the stationary element comprises a rectangular portion bearing said tidal range table thereon and a semicircular portion having a diameter smaller than said disk extending above said rectangular portion on common centers such as to expose a portion of the circumference of the disk, which exposed portion bears said sequential time interval indicia thereon.

12. The calculator device of claim 1 wherein said reference means comprises a reference line extending from each column of said sequentially arranged tide depth entries, across said semicircular portion, and terminating at the margin of said semicircular portion at the location of the sequential time interval corresponding thereto.

13. The calculator device of claim 11 including means to visually demarcate adjacent time interval indicia of said disk, said means comprising arcuate bars located at the interior circumference of the exposed portion of the disk and embracing alternate time intervals, each said bar terminating at the limits of the time interval embraced thereby.

14. The calculator device of claim 11 wherein said indexing means comprises an indexing window located at one end of said semicircular portion of the stationary element whereby any one of said time interval indicia of said disk can be caused to appear by said relative motion of the disk relative to the stationary element.

15. The calculator device of claim 14 including a second window located at the apex of said semicircular portion and a third window located at the other end of said semicircular portion, wherein, upon indexing of said disk to said stationary element so as to expose the starting time of a tidal cycle in said indexing window, there is exposed in said second window the intermediate time of the tidal cycle and in said third window the finishing time of the tidal cycle.

* * * * *